US010879029B2

(12) United States Patent
Yamada et al.

(10) Patent No.: US 10,879,029 B2
(45) Date of Patent: Dec. 29, 2020

(54) CHARGED PARTICLE DEVICE, STRUCTURE MANUFACTURING METHOD, AND STRUCTURE MANUFACTURING SYSTEM

(71) Applicants: NIKON CORPORATION, Tokyo (JP); NIKON METROLOGY NV, Leuven (BE)

(72) Inventors: Atsushi Yamada, Yokohama (JP); Shohei Suzuki, Chigasaki (JP); Takeshi Endo, Yokohama (JP); Takashi Watanabe, Tring (GB); Stephen Fletcher, Croxley Green (GB); Andriy Denysov, Milton Keynes (GB)

(73) Assignee: Nikon Corporation, Tokyo (JP)

( * ) Notice: Subject to any disclaimer, the term of this patent is extended or adjusted under 35 U.S.C. 154(b) by 105 days.

(21) Appl. No.: 16/065,903

(22) PCT Filed: Dec. 25, 2015

(86) PCT No.: PCT/JP2015/086384
§ 371 (c)(1),
(2) Date: Jun. 25, 2018

(87) PCT Pub. No.: WO2017/109981
PCT Pub. Date: Jun. 29, 2017

(65) Prior Publication Data

US 2019/0013174 A1 Jan. 10, 2019

(51) Int. Cl.
*H01J 35/16* (2006.01)
*H01J 1/92* (2006.01)
(Continued)

(52) U.S. Cl.
CPC ..... *H01J 35/16* (2013.01); *H01J 1/52* (2013.01); *H01J 1/92* (2013.01); *H01J 9/42* (2013.01);
(Continued)

(58) Field of Classification Search
CPC ..... H01J 35/16; H01J 35/08; H01J 35/165; H01J 1/52; H01J 1/92; H01J 9/42; H01J 2237/032; H01J 2235/0233; H01J 35/10
See application file for complete search history.

(56) References Cited

U.S. PATENT DOCUMENTS 1,607,952 A 11/1926 Holst et al.
4,618,977 A 10/1986 Brettschneider et al.
(Continued)

FOREIGN PATENT DOCUMENTS

GB 1 272 498 A 4/1972
JP S58-80251 A 5/1983
(Continued)

OTHER PUBLICATIONS

U.S. Appl. No. 15/776,716 (US 2018-0301312 A1), filed Oct. 18, 2018, Ian George Haig et al.
(Continued)

*Primary Examiner* — Christine S. Kim
(74) *Attorney, Agent, or Firm* — Finnegan, Henderson, Farabow, Garrett & Dunner, L.L.P.

(57) ABSTRACT

A charged particle device includes an electron emitting part for emitting electrons, an electron irradiated part configured to be irradiated with the electrons emitted from the electron emitting part, a container part configured to evacuate an interior thereof and contain the electron irradiated part in the interior thereof, an electric wire containing part configured to be inserted from an outside of the container part via an insertion part provided in the container part to contain an
(Continued)

electric wire through which electricity is conducted to the electron irradiated part contained in the container part, and an insertion-part-side protrusion part configured to surround the electric wire containing part and protrude from a vicinity of the insertion part on an inner wall of the container part to an interior of the container part.

18 Claims, 10 Drawing Sheets

(51) Int. Cl.

| | |
|---|---|
| ***H01J 35/08*** | (2006.01) |
| ***H01J 9/42*** | (2006.01) |
| ***H01J 1/52*** | (2006.01) |
| *H01J 35/10* | (2006.01) |

(52) U.S. Cl.
CPC ..... *H01J 35/08* (2013.01); *H01J 35/165* (2013.01); *H01J 35/10* (2013.01); *H01J 2235/0233* (2013.01); *H01J 2237/032* (2013.01)

(56) References Cited

U.S. PATENT DOCUMENTS

| | | | | |
|---|---|---|---|---|
| 5,936,244 | A | 8/1999 | Yajima et al. | |
| 6,816,574 | B2 * | 11/2004 | Hansen | H01R 33/7678 378/121 |
| 2009/0285360 | A1 * | 11/2009 | Cao | H01J 35/16 378/98 |
| 2011/0038463 | A1 * | 2/2011 | Behling | H01J 35/16 378/140 |
| 2012/0163539 | A1 | 6/2012 | van der Veen et al. | |
| 2013/0083896 | A1 | 4/2013 | Watanabe | |
| 2017/0053771 | A1 * | 2/2017 | Jeong | H01J 35/065 |
| 2018/0301312 | A1 * | 10/2018 | Haig | H01J 35/16 |
| 2019/0295803 | A1 * | 9/2019 | Hansen | A61B 6/035 |

FOREIGN PATENT DOCUMENTS

| | | | | |
|---|---|---|---|---|
| JP | 2005-259543 | A | | 9/2005 |
| JP | 2009-245806 | A | | 10/2009 |
| JP | 2013-217773 | A | | 10/2013 |
| JP | 2013217773 | A | * | 10/2013 |
| WO | WO 2017/108923 | A1 | | 6/2017 |

OTHER PUBLICATIONS

Notice of Reasons for Rejection dated Apr. 15, 2019 by the Japanese Patent Office in Counterpart Application No. 2018-530498, and English Translation Thereof.

Partial Supplementary European Search Report dated Jun. 28, 2019, issued in counterpart European Patent Application No. 15911415.6.

Extended European Search Report dated Aug. 26, 2019, issued in counterpart European Patent Application No. 15911415.6.

The First Office Action dated Sep. 3, 2019, issued in counterpart Chinese Patent Application No. 2015800855356.

International Search Report issued by the Japan Patent Office in in International Application No. PCT/JP2015/086384, dated Mar. 29, 2016.

* cited by examiner (a)

(b)

(a)

(b)

CHARGED PARTICLE DEVICE, STRUCTURE MANUFACTURING METHOD, AND STRUCTURE MANUFACTURING SYSTEM

This application is a National Stage of International Application No. PCT/JP2015/086384, filed Dec. 25, 2015, titled, Charged Particle Device, Structure Manufacturing Method, and Structure Manufacturing System, the entire content of which is incorporated herein by reference.

TECHNICAL FIELD

The present invention relates to a charged particle device, a structure manufacturing method, and a structure manufacturing system.

BACKGROUND ART

There has been known a charged particle device that irradiates a target with an electron beam (Patent Literature 1).

CITATION LIST

Patent Literature

PTL 1: United States Patent Application No. 2013/0083896

SUMMARY OF INVENTION

According to the first aspect of the present invention, a charged particle device comprises an electron emitting part configured to emit electrons, an electron irradiated part configured to be irradiated with the electrons emitted from the electron emitting part, a container part configured to evacuate an interior thereof and contain the electron irradiated part in the interior thereof, an electric wire containing part configured to be inserted from an outside of the container part via an insertion part provided in the container part to contain an electric wire through which electricity is conducted to the electron irradiated part contained in the container part, and an insertion-part-side protrusion part configured to surround the electric wire containing part and protrude from a vicinity of the insertion part on an inner wall of the container part to an interior of the container part.

According to the second aspect of the present invention, a structure manufacturing method comprises a design process of producing design information regarding a shape of a structure, a shaping process of manufacturing the structure based on the design information, a measuring process of measuring the shape of the manufactured structure by using the charged particle device according to the first aspect, and an inspection process of comparing shape information obtained from the measuring process with the design information.

According to the third aspect of the present invention, a structure manufacturing system comprises a design device configured to produce design information regarding a shape of a structure, a shaping device configured to manufacture the structure based on the design information, the charged particle device according to the first aspect configured to measure the shape of the manufactured structure, and an inspection device configured to compare the shape information regarding the shape of the structure, the shape information being obtained by an X-ray device using the X-ray generation device, with the design information.

DESCRIPTION OF EMBODIMENTS

Hereinafter, embodiments of the present invention will be described with reference to drawings, but the present invention is not limited to these embodiments. In addition, as for the illustration of the drawings, a reduced scale is appropriately changed by increasing or emphasizing part of the drawings in order to describe the embodiments. In the following descriptions, an XYZ orthogonal coordinate system is set, and positional relationships between elements will be described with reference to the XYZ orthogonal coordinate system. A predetermined direction in a horizontal plane is defined as a Z-axis direction, a direction orthogonal to the Z-axis direction in the horizontal plane is defined as an X-axis direction, and a direction orthogonal to both the Z-axis direction and the X-axis direction (in other words, a vertical direction) is defined as a Y-axis direction. Furthermore, rotation (tilt) directions relative to an X-axis, a Y-axis, and a Z-axis are defined as θX, θY, and θZ directions, respectively.

First Embodiment

A charged particle device according to a first embodiment will be described with reference to drawings and exemplified by an X-ray generation device. Note that, the first embodiment is aimed at specifically describing the gist of the invention for understanding, but the present invention is not limited to this unless otherwise specified.

Figure 1:
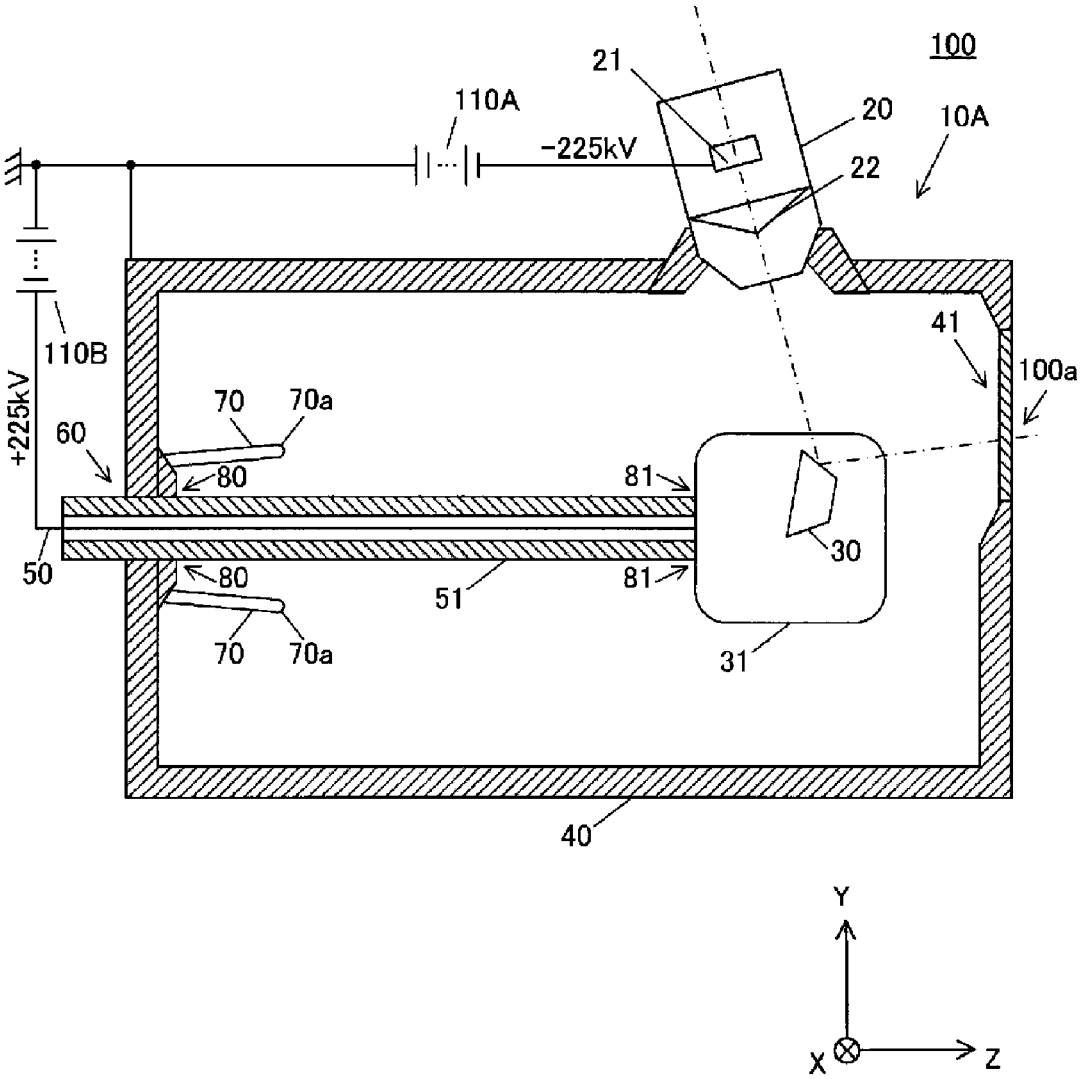
FIG. 1 is a schematic configuration diagram of a charged particle device of a first embodiment.

FIG. 1 is a schematic configuration diagram of an X-ray generation device 10A according to the first embodiment. The X-ray generation device 10A includes an electron emitting part 20, an electron irradiated part 30, a mounting stage 31 on which the electron irradiated part 30 is mounted, a container part 40, an electric wire containing part 51 for containing an electric wire 50, an insertion part 60 for inserting the electric wire containing part 51, and an insertion-part-side protrusion part 70. In the X-ray generation device 10A, an electron beam emitted from the electron emitting part 20 reaches the electron irradiated part 30, thereby emitting X-rays from the electron irradiated part 30.

The electron emitting part 20 is configured to include a filament 21 and an intermediate electrode 22. The electron emitting part 20 can evacuate its interior and can be brought into a vacuum state by an evacuation system such as a vacuum pump. The filament 21, for example, is formed of material including tungsten and configured to include a tip end sharply pointed to the electron irradiated part 30. The intermediate electrode 22 includes an opening through which electrons discharged from the filament 21 pass.

The X-ray generation device 10A includes a high voltage power source 110A and a high voltage power source 110B. The high voltage power source 110A is connected to the filament 21 via an electric wire that can supply a high voltage and applies a negative voltage (e.g., −225 kV) with respect to the intermediate electrode 22 having a ground potential, to the filament 21. In addition, the high voltage power source 110B is connected to the electron irradiated part 30 via the electric wire 50 and applies a positive voltage (e.g., +225 kV) with respect to the intermediate electrode 22, to the electron irradiated part 30. That is, the filament 21 has a high negative voltage (e.g., −450 kV) with respect to the electron irradiated part 30. The intermediate electrode 22 is set to have an earth potential (ground potential).

The aforementioned negative voltage is applied to the filament 21, and a current for heating is separately passed through the filament 21, which heats the filament 21 and causes an electron beam (thermoelectron) to be emitted from the tip end of the filament 21 to the electron irradiated part 30. That is, when a high voltage is applied to the filament 21 by the high voltage power source 110A, the filament 21 functions as a cathode that emits the electron beam. As described above, in the present embodiment, the cathode that uses the thermoelectrons generated by the heated filament is provided, but a cathode that emits the electron beam by forming an electric field having high intensity in the periphery of the cathode without heating the cathode or that utilizes a Schottky effect may be provided.

The electron beam emitted from the filament 21 proceeds to the electron irradiated part 30 while being accelerated by a potential difference (e.g., 450 kV) between the filament 21 and the electron irradiated part 30. For example, the electron beam proceeds to the electron irradiated part 30 while being accelerated by an acceleration voltage of 450 kV. The electron beam is converged by an electron optical member that is provided in the electron emitting part 20 and not illustrated, and collides with the electron irradiated part 30 arranged at the convergence position (focal spot) of the electron optical member.

The electron irradiated part 30 is typically referred to as a target, for example, formed of material including tungsten, and generates X-rays by colliding the electron beam emitted from the filament 21 with the electron irradiated part 30. As illustrated in FIG. 1, the X-ray generation device 10A of the present embodiment is configured as a reflective X-ray generation device that emits X-rays in the reflection direction of the electron beam collided with the electron irradiated part 30, as an example. Thus, in the present embodiment, a direction in which the electron beam enters the electron irradiated part 30 is different from the irradiation direction of the X-rays emitted from the electron irradiated part 30. Note that the X-ray generation device is not limited to the reflective type, but a transmissive X-ray generation device that emits the X-rays in a transmissive direction of the electron beam collided with the electron irradiated part 30 may be provided. In this case, the direction in which the electron beam enters the electron irradiated part 30 is identical to the direction in which the X-rays are emitted from the electron irradiated part 30.

As described above, the electron irradiated part 30 is irradiated with the electron beam, thereby emitting X-rays having a conical shape (what is called a cone beam) from the electron irradiated part 30. The X-rays are emitted to the outside of the container part 40 via an X-ray transmissive part 41. The X-ray transmissive part 41 is formed of material through which the X-rays penetrate. Note that the X-ray generation device 10A emits the X-rays having a conical shape (cone beam), but an X-ray generation device that emits X-rays having a flat fan shape (what is called "fan beam") or linear X-rays (what is called "pencil beam") is also included in one aspect of the present invention. The X-ray generation device 10A, for example, emits at least one of: ultrasoft X-rays of approximately 50 eV, soft X-rays of approximately 0.1 to 2 keV, X-rays of approximately 2 to 20 keV, and hard X-rays of approximately 20 to 100 keV. The X-ray generation device 10A may emit X-rays of 1 to 10 MeV. Naturally, The X-ray generation device 10A emits X-rays having an energy of 1 MeV or higher may be included. In addition, the wavelengths of the plurality of X-rays may be selected from among the aforementioned ranges as appropriate. Naturally, X-rays having all the wavelength regions may be selected. In addition, X-rays having a single wavelength may be selected. Needless to say, the present embodiment is not limited to the X-rays in the aforementioned ranges, but may include electromagnetic waves except for the aforementioned ranges.

The container part 40 contains the electron irradiated part 30 and the mounting stage 31 in the interior thereof. The container part 40 is formed of conductive material such as stainless steel. The container part 40 is electrically grounded with a ground wire and has an earth potential. The container part 40 can evacuate its interior and is brought into a vacuum state by an evacuation system. The outer wall of the electron emitting part 20 is configured to include a conductive material and have the same earth potential as that of the container part 40. The container part 40 is set to have an earth potential (ground potential).

The insertion part 60 is provided in the container part 40, and the electric wire containing part 51 is inserted from the outside of the container part 40 into the insertion part 60. The electric wire containing part 51 contains the electric wire 50 through which electricity is conducted to the electron irradiated part 30. The electric wire containing part 51 is formed of dielectric material such as ceramic and electrically insulates the electric wire 50 with members in the periphery of the electric wire containing part 51 or the like.

The electron irradiated part 30 is mounted on the mounting stage 31. The electron irradiated part 30 is also referred to as a target irradiated with the electron beam. A positive voltage with respect to the intermediate electrode 22 is applied by the high voltage power source 110B to the electron irradiated part 30 and the mounting stage 31. As described above, the intermediate electrode 22 is configured to have an earth potential, so that the electron irradiated part 30 and the mounting stage 31 have a positive potential with respect to the container part 40. A refrigerant such as cooling water for cooling the electron irradiated part 30 is supplied to the interior of the X-ray generation device 10A.

In the container part 40, there are sections in which three areas composed of an area formed of the conductive material, an area formed of the dielectric material, and a vacuum area are abutted to each other. These sections are referred to as "triple junction section" in this Specification. In FIG. 1, the triple junction sections are illustrated as a triple junction section 80 and a triple junction section 81. The triple junction section 80 is a section in which the container part 40 formed of the conductive material, the electric wire containing part 51 formed of the dielectric material, and the vacuum area in the interior of the container part 40 are abutted. The triple junction section 81 is a section in which the mounting stage 31 formed of the conductive material, the electric wire containing part 51 formed of the dielectric material, and the vacuum area in the interior of the container part 40 are abutted. The electric potential of the container part 40 is an earth potential, and the electric potential of the mounting stage 31 is a positive potential, so that the triple junction section 80 on a far side from the mounting stage 31 is a triple junction on a low potential side, and the triple junction section 81 on a near side with respect to the mounting stage 31 is a triple junction on a high potential side. In the present embodiment, the insertion-part-side protrusion part 70 for surrounding the triple junction section 80 on the low potential side on the inner wall of the container part 40 is provided. This allows the slope of the potential distribution in the vicinity of the triple junction section 80 to be gently formed, and as a result, occurrence of electric discharge in the vicinity of the triple junction section 80 can be prevented.

The insertion-part-side protrusion part 70 surrounds the electric wire containing part 51 and protrudes in a conical shape from the inner wall of the container part 40 to the interior of the container part 40. The insertion-part-side protrusion part 70 is formed of the conductive material and fixed on the inner wall of the container part 40. Thus, the electric potential of the insertion-part-side protrusion part 70 is the same earth ground as that of the container part 40. The tip end part 70*a* of the insertion-part-side protrusion part 70 is formed in a smooth shape having no edge. For example, the cross section of the tip end part 70*a* is formed in a convex curve (e.g., an arc shape) or a semispherical shape. This prevents an electric field from concentrating in the vicinity of the tip end part 70*a* of the insertion-part-side protrusion part 70. Note that the insertion-part-side protrusion part 70 need not be formed in a conical shape, and may be formed in a cylindrical shape extended in parallel to the electric wire containing part 51, and any shape will be applied. In addition, in the present embodiment, a surface that surrounds the circumference of the Z-axis direction is formed, but the formed surface need not be successive. The surface forming the insertion-part-side protrusion part 70 need not surround the entire circumference of the Z-axis direction, but the surface may be partially disrupted. Further, in the Z-axis direction, the position of the tip end part 70*a* of the insertion-part-side protrusion part 70 need not be identical. For example, in FIG. 1, the position of the tip end part 70*a* may be different. For example, the position of the tip end part 70*a* in the Z-axis direction on a side where the electron emitting part 20 is provided along the Y axis of FIG. 1 may be brought closer to the triple junction section 81. The size of the insertion-part-side protrusion part 70 can be selected as appropriate. Similarly, shape and size of an electron irradiated-part-side protrusion part 71 described later can be selected as appropriate. In addition, in FIG. 1, on an X-Y plane, the central position of a circle formed by the tip end part 70*a* conforms to the central position of the insertion part 60, but need not conform with each other.

Figure 2:
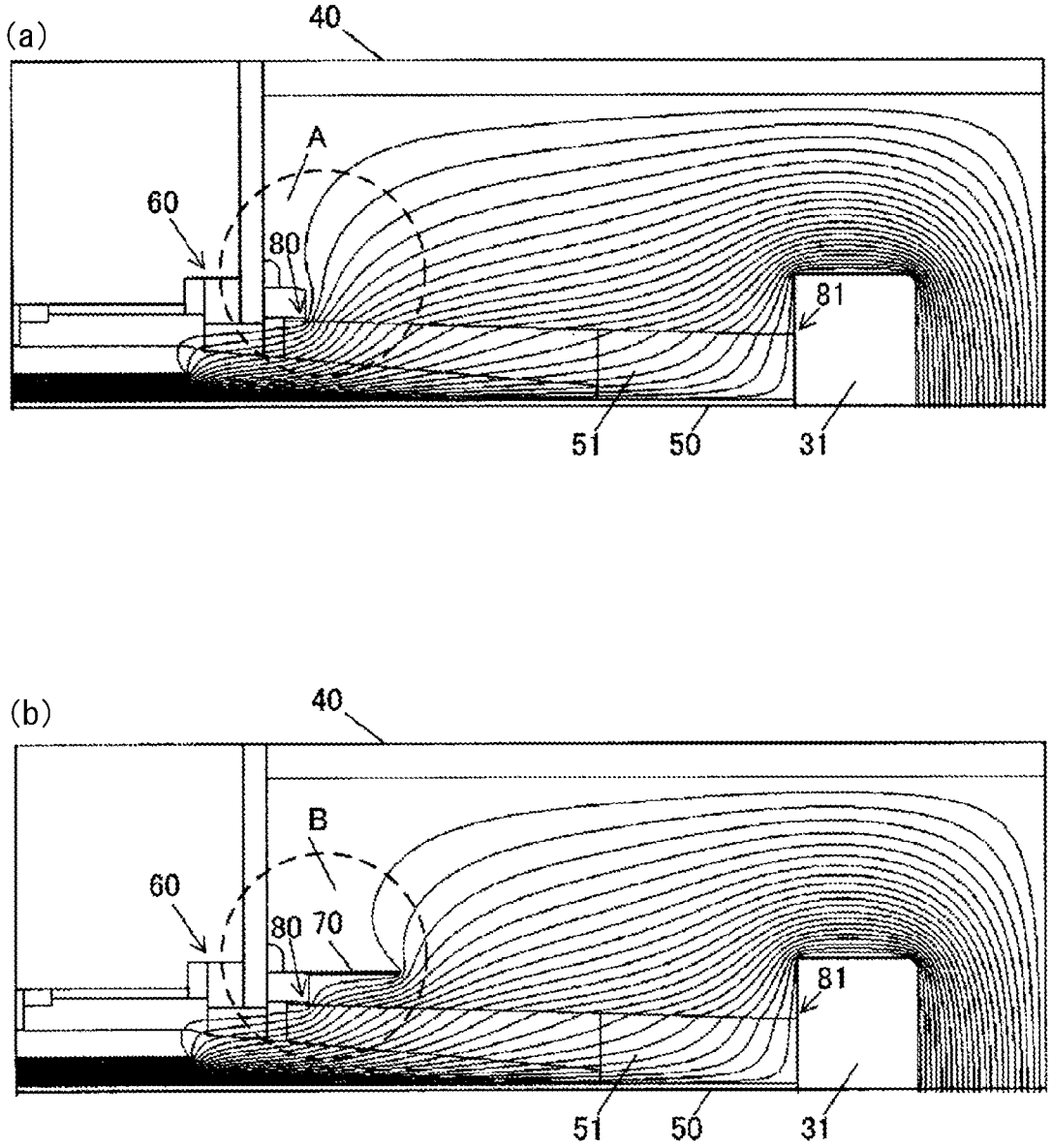
FIG. 2(*a*) is an explanatory view illustrating a simulation result of potential distribution in a space of a container part in a case where an insertion-part-side protrusion part is not provided, and FIG. 2(*b*) is an explanatory view illustrating a simulation result of potential distribution in the space of the container part in a case where the insertion-part-side protrusion part is provided.

FIG. 2 is an explanatory view illustrating the simulation results of the potential distribution in a space of the container part 40. FIG. 2(*a*) is an explanatory view illustrating a case where the insertion-part-side protrusion part 70 is not provided, and FIG. 2(*b*) is an explanatory view illustrating a case where the insertion-part-side protrusion part 70 is provided. Curves illustrated in the space of the container part 40 in FIG. 2 represent equipotential lines illustrated in increments of 10 kV. In the X-ray generation device 10A illustrated in FIG. 2, +225 kV is applied to the mounting stage 31, and the container part 40 has an earth potential (0 V).

Figure 3:
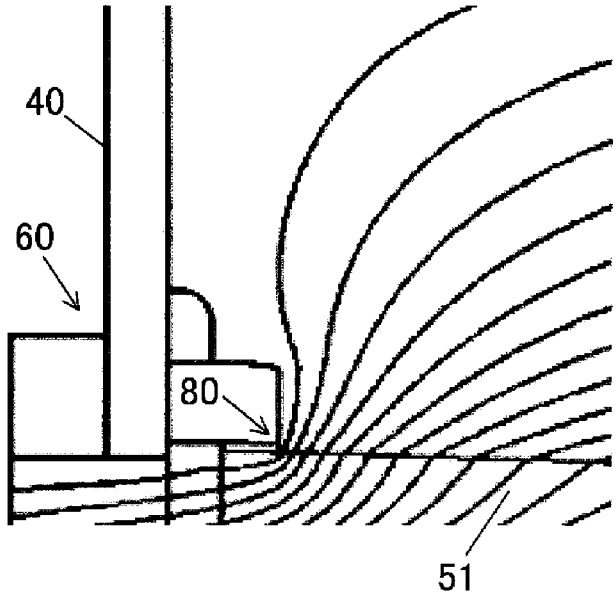
FIG. 3(*a*) is an enlarged view of an area A enclosed by a dashed line in FIG. 2(*a*), and FIG. 3(*b*) is an enlarged view of an area B enclosed by a dashed line in FIG. 2(*b*).
Figure 3:
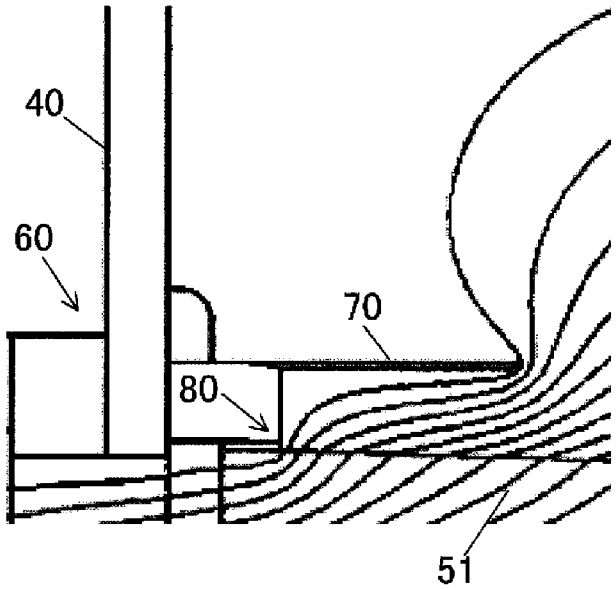

Next, a difference in simulation results between the case where the insertion-part-side protrusion part 70 is provided and the case where the insertion-part-side protrusion part 70 is not provided will be described with reference to FIGS. 3(*a*) and 3(*b*). FIG. 3(*a*) is an enlarged view of an area A enclosed by a dashed line in FIG. 2(*a*), and FIG. 3(*b*) is an enlarged view of an area B enclosed by a dashed line in FIG. 2(*b*).

As illustrated in FIG. 3(*a*), in the case where the insertion-part-side protrusion part 70 is not provided, the intervals of the equipotential lines are narrow in the neighborhood of the triple junction section 80. This indicates that the electric potential gradient of this part is steep. That is, this indicates that an electric field concentrates in the vicinity of the triple junction section 80. In this case, electric discharge is prone to occur in the vicinity of the triple junction section 80.

In contrast, as illustrated in FIG. 3(*b*), in the case where the insertion-part-side protrusion part 70 is provided, the intervals of the equipotential lines are wide in the vicinity of the triple junction section 80, compared with the case where the insertion-part-side protrusion part 70 is not provided (that is, the case illustrated in FIG. 3(*a*)). That is, compared with the case illustrated in FIG. 3(*a*), electric discharge is hard to be generated in the vicinity of the triple junction section 80. These results show that occurrence of electric discharge can be prevented in the vicinity of the triple junction section 80 by providing the insertion-part-side protrusion part 70 on the inner wall of the container part 40.

According to the first embodiment described above, the following advantageous effects are achieved.

(1) The charged particle device comprises the electron emitting part 20 configured to emit electrons, the electron irradiated part 30 configured to be irradiated with the electrons emitted from the electron emitting part 20, the container part 40 configured to evacuate the interior thereof and contain the electron irradiated part 30 in the interior thereof, the electric wire containing part 51 configured to be inserted from the outside of the container part 40 via the insertion part 60 provided in the container part 40 to contain the electric wire 50 through which electricity is conducted to the electron irradiated part 30 contained in the container part 40, and the insertion-part-side protrusion part 70 configured to surround the electric wire containing part 51 and protrude from the vicinity of the insertion part 60 on the inner wall of the container part 40 to the interior of the container part 40. In the first embodiment, the insertion-part-side protrusion part 70 surrounds the electric wire containing part 51 and protrudes. This allows the electric potential gradient in the vicinity of the triple junction section 80 to be gently formed, thereby preventing occurrence of electric discharge in the vicinity of the triple junction section 80.

(2) In the charged particle device, the insertion-part-side protrusion part 70 is provided in the vicinity of the triple junction section 80 on the low potential side. The vicinity of the triple junction section 80 on the low potential side can be an emission source of electrons. In the first embodiment, providing the insertion-part-side protrusion part 70 enables the electric potential gradient in the vicinity of the triple junction section 80 to be gradually formed, so that occurrence of electric discharge in the vicinity of the triple junction section 80 can be prevented.

(3) As described above, the charged particle device includes the insertion-part-side protrusion part 70, which enables the prevention of occurrence of electric discharge in the vicinity of the triple junction section 80, thereby avoiding the deterioration of the degree of vacuum in the container part 40 due to the electric discharge. This allows the X-ray generation device 10A to stably operate. In addition, the damage of the X-ray generation device 10A due to the occurrence of intense electric discharge can be prevented.

(4) In the charged particle device, the tip end part 70*a* of the insertion-part-side protrusion part 70 is formed in a smooth shape. This prevents the concentration of electric fields at the tip end part 70*a* of the insertion-part-side protrusion part 70.

(5) In the charged particle device, upon the irradiation of the electron irradiated part 30 with electrons, the electron irradiated part 30 emits X-rays. With this configuration, the charged particle device can be used for various X-ray generation devices.

Second Embodiment

An X-ray generation device 10B according to a second embodiment will be described with reference to FIG. 4. In the description below, the same reference number is applied to the same element similar to that of the first embodiment, and differences will be mainly described. Features that are not specifically described are similar to those of the first embodiment. The present embodiment is different from the first embodiment in that the X-ray generation device 10B further includes an electron irradiated-part-side protrusion part 71.

Figure 4:
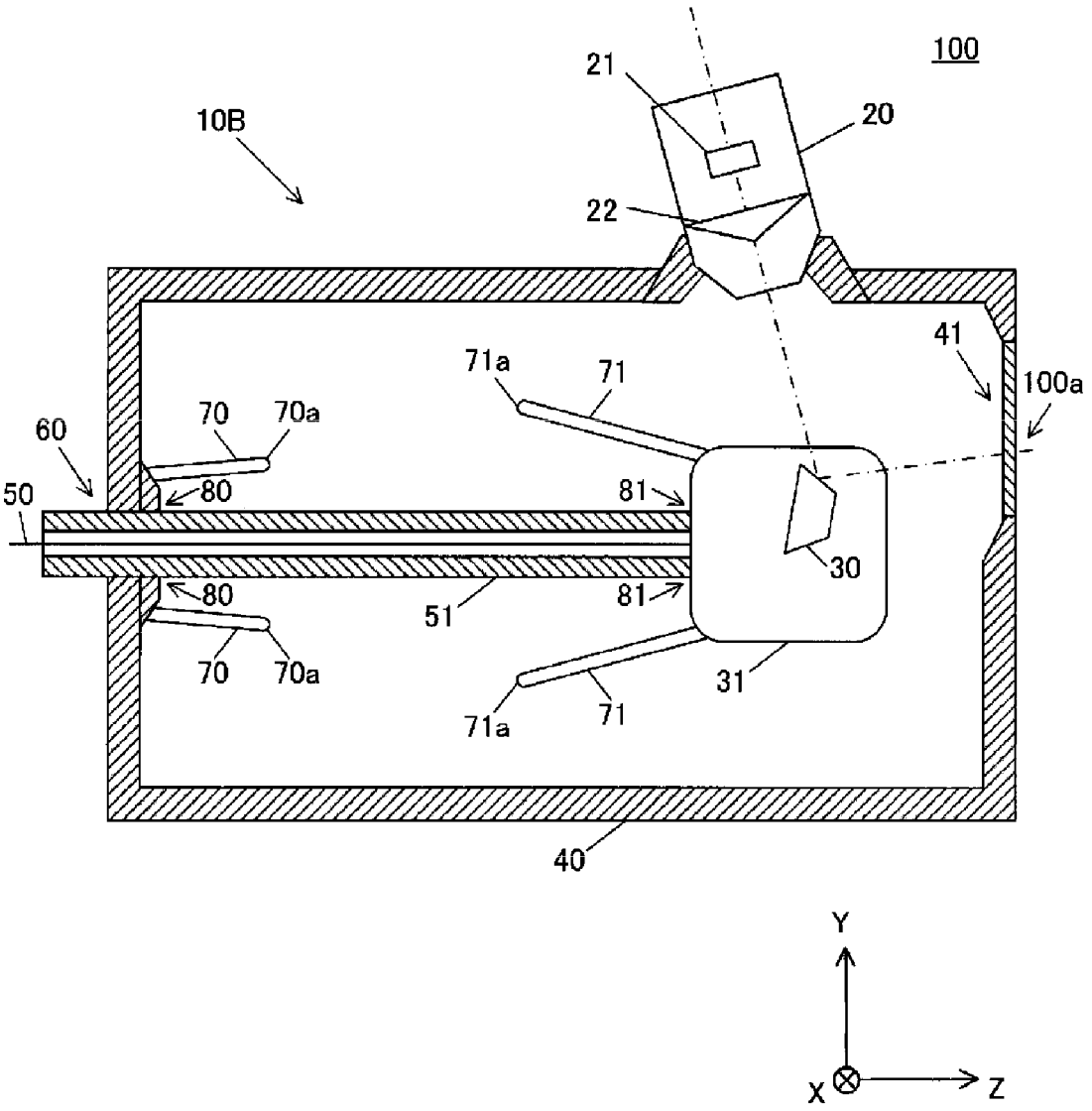
FIG. 4 is a schematic configuration diagram of a charged particle device of a second embodiment.

FIG. 4 is a schematic configuration diagram of the X-ray generation device 10B according to the second embodiment. As described above, the X-ray generation device 10B according to the present embodiment is different from the X-ray generation device 10A of the first embodiment in that the X-ray generation device 10B further includes the electron irradiated-part-side protrusion part 71. Note that the illustration of the high voltage power source 110 is omitted in FIG. 4. The electron irradiated-part-side protrusion part 71 is provided so as to surround the triple junction section 81 on a high potential side. That is, the electron irradiated-part-side protrusion part 71 surrounds the electric wire containing part 51 and protrudes in a conical shape from the vicinity of the electron irradiated part 30 to the inner wall of the container part 40. The electron irradiated-part-side protrusion part 71 is formed of the conductive material and fixed on the mounting stage 31. Thus, the electric potential of the electron irradiated-part-side protrusion part 71 is the same positive potential as that of the mounting stage 31.

The tip end part 71*a* of the electron irradiated-part-side protrusion part 71 is formed in a smooth shape having no edge. For example, the cross section of the tip end part 71*a* is formed in a convex curve (e.g., an arc shape) or a semispherical shape. This prevents the concentration of electric fields in the vicinity of the tip end part 71*a* of the electron irradiated-part-side protrusion part 71. Note that the electron irradiated-part-side protrusion part 71 need not be formed in a conical shape, and may be formed in a cylindrical shape extended in parallel to the electric wire containing part 51, and any shape will be applied.

Figure 5:
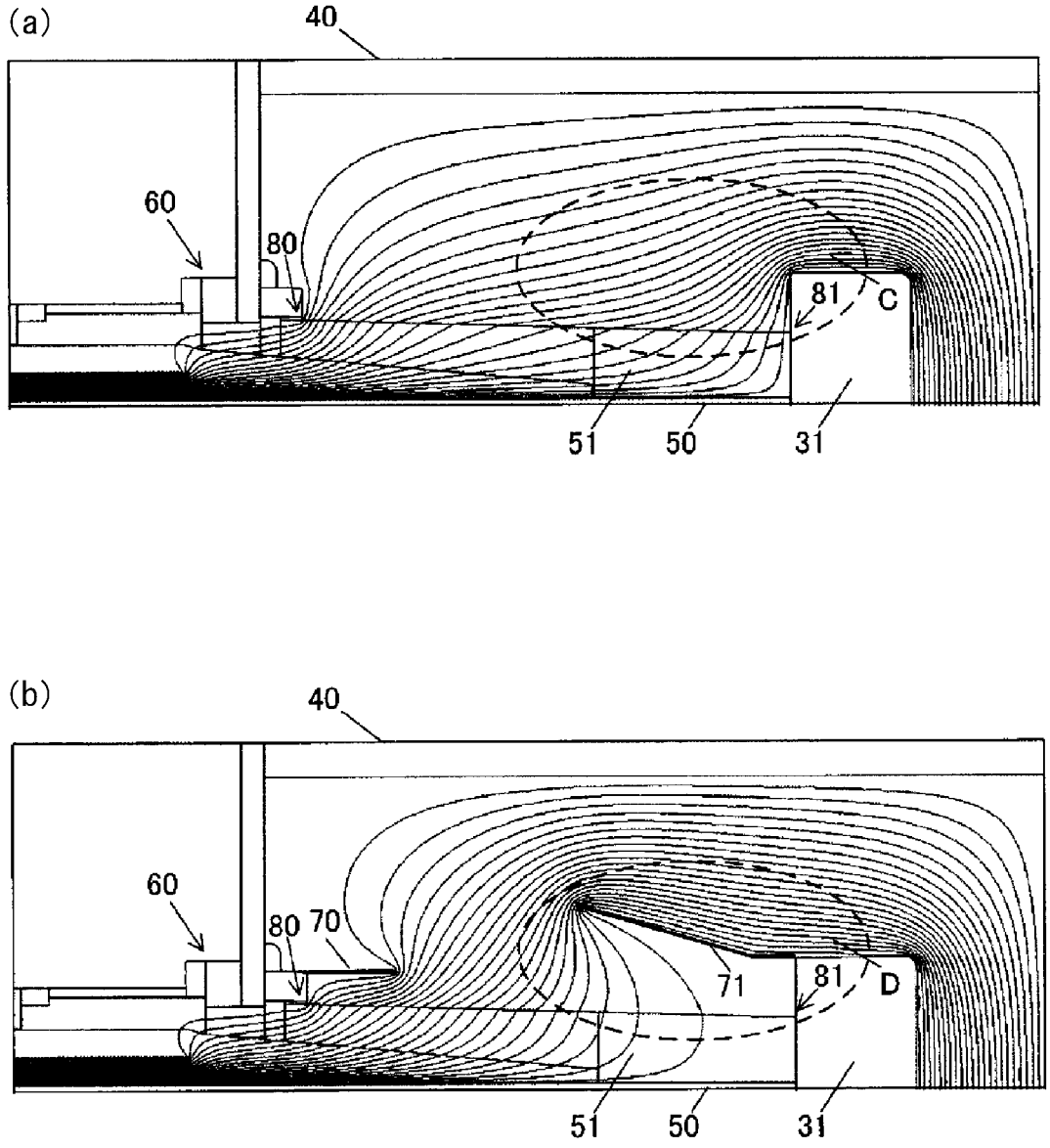
FIG. 5(*a*) is an explanatory view illustrating a simulation result of potential distribution in the space of a container part in a case where an electron irradiated-part-side protrusion part is not provided, and FIG. 5(*b*) is an explanatory view illustrating a simulation result of potential distribution in the space of the container part in a case where the electron irradiated-part-side protrusion part is provided.

FIG. 5 is an explanatory view illustrating the simulation results of the potential distribution in the space of the container part 40. FIG. 5(*a*) is an explanatory view illustrating a case where the electron irradiated-part-side protrusion part 71 is not provided, and FIG. 5(*b*) is an explanatory view illustrating a case where the electron irradiated-part-side protrusion part 71 is provided. Curves illustrated in the space of the container part 40 in FIG. 5 represent equipotential lines illustrated in increments of 10 kV. In the X-ray generation device 10B illustrated in FIG. 5, +225 kV is applied to the mounting stage 31, and the container part 40 has an earth potential (0 V).

Figure 6:
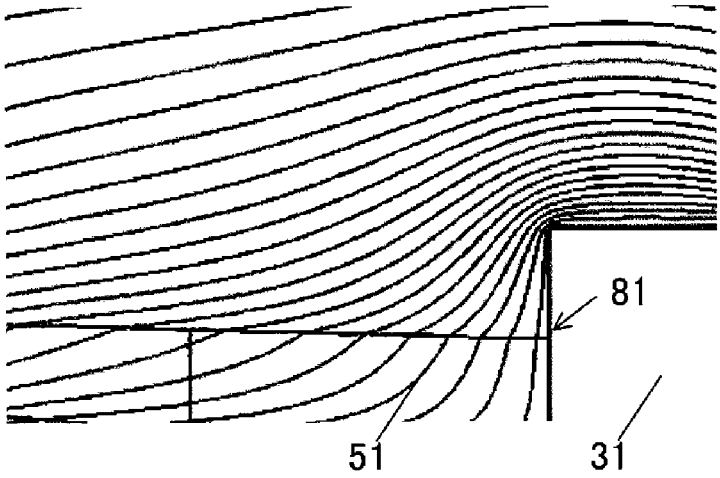
FIG. 6(*a*) is an enlarged view of an area C enclosed by a dashed line in FIG. 5(*a*), and FIG. 6(*b*) is an enlarged view of an area D enclosed by a dashed line in FIG. 5(*b*).
Figure 6:
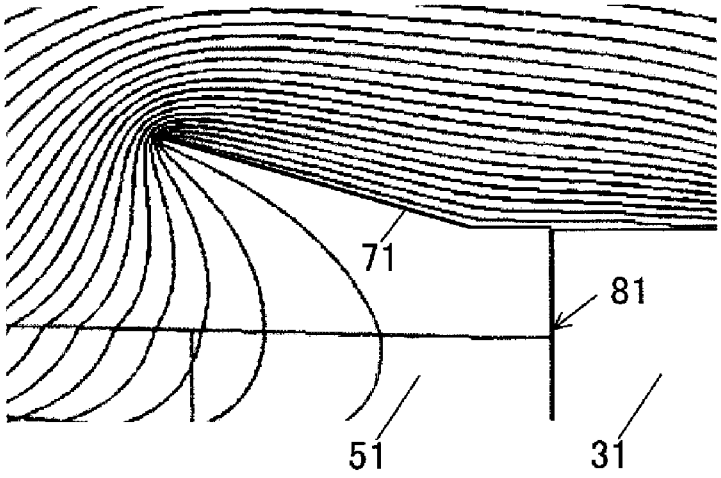

Next, a difference in simulation results between the case where the electron irradiated-part-side protrusion part 71 is provided and the case where the electron irradiated-part-side protrusion part 71 is not provided will be described with reference to FIGS. 6(*a*) and 6(*b*). FIG. 6(*a*) is an enlarged view of an area C enclosed by a dashed line in FIG. 5(*a*), and FIG. 6(*b*) is an enlarged view of an area D enclosed by a dashed line in FIG. 5(*b*).

As illustrated in FIG. 6(*a*), in the case where the electron irradiated-part-side protrusion part 71 is not provided, the intervals of the equipotential lines are narrow in the neighborhood of the triple junction section 81. This indicates that the electric potential gradient of this part is steep. That is, this indicates that the electric field concentrates in the vicinity of the triple junction section 81. In this case, electric discharge is prone to occur in the vicinity of the triple junction section 81.

In contrast, as illustrated in FIG. 6(*b*), in the case where the electron irradiated-part-side protrusion part 71 is provided, the intervals of the equipotential lines are wide in the vicinity of the triple junction section 81, compared with the case where the electron irradiated-part-side protrusion part 71 is not provided (that is, the case illustrated in FIG. 6(*a*)). That is, compared with the case illustrated in FIG. 6(*a*), electric discharge is hard to be generated in the vicinity of the triple junction section 81. These results show that occurrence of electric discharge can be prevented in the vicinity of the triple junction section 81 by providing the electron irradiated-part-side protrusion part 71 on the mounting stage 31.

According to the second embodiment described above, the following advantageous effects are achieved in addition to the advantageous effects similar to those of the first embodiment.

(6) The charged particle device further includes the electron irradiated-part-side protrusion part 71 for surrounding the electric wire containing part 51 and protruding from the vicinity of the electron irradiated part 30 to the inner wall of the container part 40. This allows the electric potential gradient in the vicinity of the triple junction section 81 to be gently formed, thereby preventing occurrence of electric discharge in the vicinity of the triple junction section 81.

Modifications such as below are also within the scope of the present invention, and it is also possible to combine one modified example or a plurality of modified examples with an embodiment described above.

Modified Example 1

Figure 7:
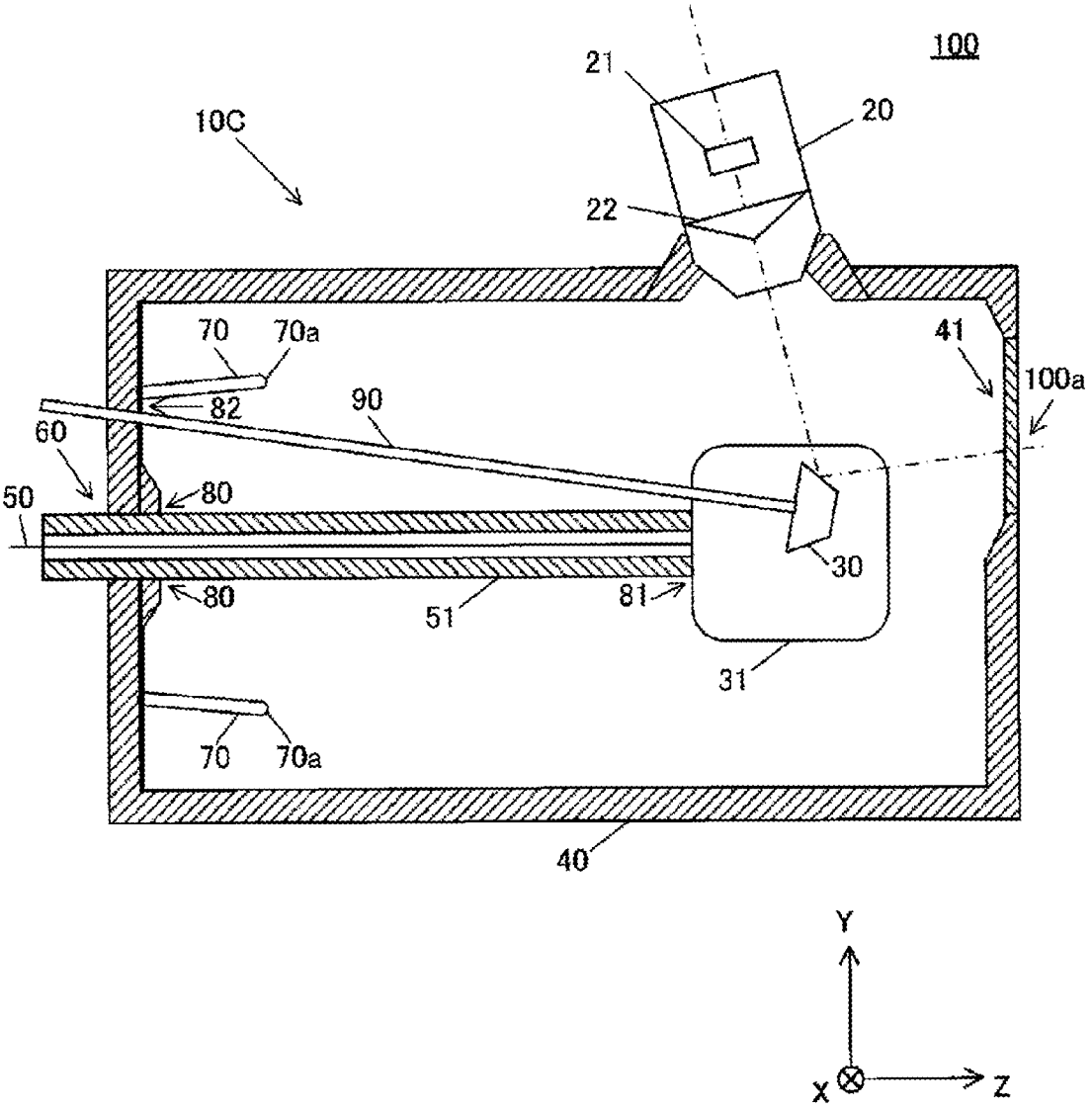
FIG. 7 is a schematic configuration diagram of a charged particle device of a modified example.

FIG. 7 is a diagram illustrating the configuration of an X-ray generation device 10C of a modified example 1. The X-ray generation device 10C includes a rotation member 90 that causes the electron irradiated part 30 (target) to rotate. The electron irradiated part 30 is rotated by the rotation member 90, thereby changing the collision positions of electron beams at the electron irradiated part 30. Changing the collision positions of electron beams keeps constant a state of irradiation with electron beams to the electron irradiated part 30, thereby keeping constant a state of X-rays emitted from the electron irradiated part 30. At least the outer circumferential part of the rotation member 90 is formed of dielectric material such as ceramic.

At least the outer circumferential part of the rotation member 90 is formed of dielectric material, and for the same reason that the triple junction section 80 is formed in the vicinity of the electric wire containing part 51, the triple junction section 82 is formed in the vicinity of the rotation member 90 in the container part 40. That is, the triple junction section 82 is formed at a section in which the container part 40 formed of the conductive material, the outer circumferential part of the rotation member 90 formed of the dielectric material, and the vacuum area in the interior of the container part 40 are abutted. In the X-ray generation device 10C, as illustrated in FIG. 7, the insertion-part-side protrusion part 70 is provided in such a manner as to surround the rotation member 90 as well as the electric wire containing part 51. This allows the potential gradient in the vicinity of the triple junction section 82 to be gently formed, and as a result, occurrence of electric discharge in the vicinity of the triple junction section 82 can be prevented.

Modified Example 2

In the aforementioned embodiments and modified examples, it has been described that the present invention is applied to the X-ray generation device 10 as the charged particle device, as one example, but the present invention can be applied to various charged particle devices such as an electron microscope, a scanning electron microscope, and a focused ion beam device. For example, an electron microscope is disclosed by U.S. Pat. No. 5,936,244.

Third Embodiment

Figure 8:
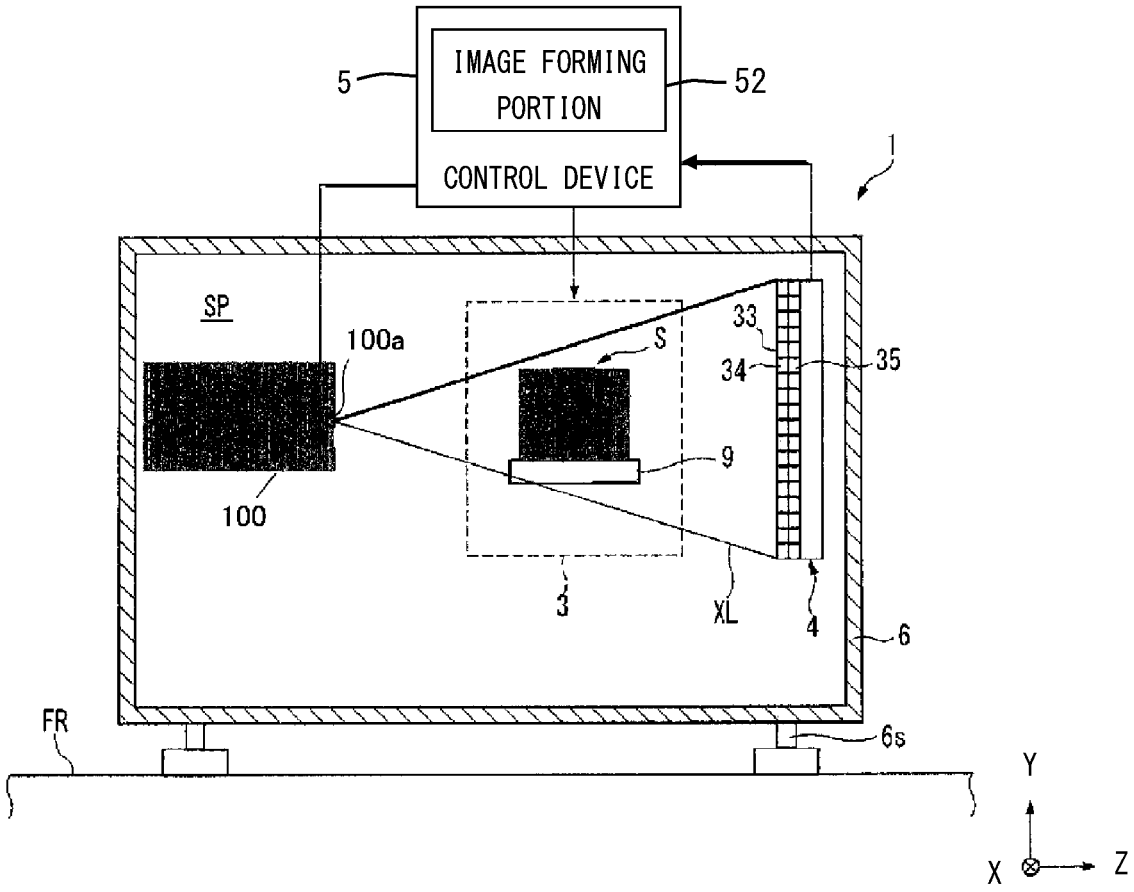
FIG. 8 is a diagram illustrating one example of the entire configuration of an X-ray device according to a third embodiment.

An X-ray device 1 using the aforementioned X-ray generation device 10 and a structure manufacturing system SYS with the X-ray device 1 will be described with reference to drawings. FIG. 8 is a diagram illustrating one example of the entire configuration of the X-ray device 1 using the aforementioned X-ray generation device 10.

As illustrated in FIG. 8, the X-ray device 1 irradiates a measurement object S with X-rays XL and detects transmitted X-rays transmitted through the measurement object S. The X-ray device 1 includes an X-ray CT scanning device that irradiates the measurement object S with X-rays, detects X-rays transmitted through the measurement object S, and obtains internal information (e.g., an internal structure) of the measurement object S in a nondestructive manner. In the present embodiment, the measurement object S, for example, includes industrial components such as mechanical components, or electronic components. The X-ray CT scanning device includes an industrial X-ray CT scanning device that inspects an industrial component by irradiating the industrial component with X-rays.

The X-ray device 1 includes an X-ray source 100 for emitting the X-rays XL, a movable stage device 3 for holding the measurement object S, a detector 4 for detecting at least part of X-rays that are emitted from the X-ray source 100 and transmitted through the measurement object S held by the stage device 3, and a control device 5 for controlling the entire operation of the X-ray device 1. The X-ray device 1 includes a chamber member 6 that forms an internal space SP through which the X-rays XL emitted from the emission opening 100*a* of the X-ray source 100 travel. The X-ray source 100, the stage device 3, and the detector 4 are arranged in the internal space SP. Note that the chamber member 6 is arranged on a support surface FR. The chamber member 6 is supported by a plurality of support members 6S.

The X-ray source 100 irradiates the measurement object S with the X-rays XL. The X-ray source 100 can adjust the intensity of the X-rays with which the measurement object S is irradiated on the basis of the X-ray absorption characteristics of the measurement object S. The X-ray source 100 includes a point X-ray source and irradiates the measurement object S with X-rays having a conical shape (what is called a cone beam). The X-ray source 100 is installed such that the longitudinal direction thereof corresponds to the Z-axis direction.

The stage device 3 includes a stage 9 and a stage driving mechanism not illustrated. The stage 9 holds the measurement object S and is movably provided. The stage 9 includes a holding part for holding the measurement object S. The stage 9 can be moved, for example, in parallel to the X direction, the Y direction, and the Z direction by means of the stage driving mechanism not illustrated and can rotate in the θY direction. Note that the position of the stage 9 (the position of the measurement object S) with the stage driving mechanism is controlled by the control device 5. Note that the mechanism of the stage device 3 is not limited to this. For example, a configuration in which the X-ray source 100 and the detector 4 are rotated may be applied in place of the rotation mechanism of the stage device 3.

The detector 4 is arranged on the opposite side of the X-ray source 100 with the stage 9 (measurement object S) sandwiched therebetween. The detector 4 is arranged on +Z side with respect to the stage 9. The detector 4, for example, is fixed at a predetermined position in the X-ray device 1 but it may constitute as to be movable. The detector 4 includes an incidence surface 33, a scintillator portion 34, a light-receiving portion 35. The incidence surface 33 is a plane formed in parallel to the X-Y plane and oriented to −Z direction. The incidence surface 33 is arranged opposite to the measurement object S held by the stage 9. The X-rays XL that are emitted from the X-ray source 100 and include transmissive X-rays transmitted through the measurement object S enter the incidence surface 33.

The scintillator portion 34 includes a scintillation material that emits light upon the collision of X-rays. The light-receiving portion 35 includes a photomultiplier tube. The photomultiplier tube includes a phototube that converts light energy into electrical energy by photoelectric effect. The light-receiving portion 35 receives the light produced by the scintillator portion 34, amplifies the light, converts the light into an electrical signal, and outputs the signal. The detector 4 includes a plurality of scintillator portions 34. The plurality of scintillator portions 34 are arranged in an array in the XY plane. The detector 4 includes a plurality of light-receiving portions 35 in such a manner that each is connected to one of the plurality of scintillator portions 34. The output results of the light-receiving portions 35 are transmitted to the control device 5.

Note that, in the present embodiment, the detector 4 includes a plurality of incidence surfaces 33, the corresponding plurality of scintillator portions 34, and the corresponding plurality of light-receiving portions 35, but is not limited to this. In the present embodiment, they are provided on the XY plane, but may be provided at least only in one axial direction (e.g., the X-axis direction). In addition, for example, a single element may be provided in place of plural elements. For example, the detector 4 may be configured to include the single incidence surface 33, the corresponding single scintillator portion 34, and the corresponding single light-receiving portion 35.

The control device 5 controls the operations of the X-ray source 100, the stage device 3 (stage 9), and the detector 4 in an integrated manner. In addition, the control device 5 includes an image forming portion 52. The image forming portion 52 forms an image of the measurement object S on the basis of the detection result of the detector 4. The image forming portion 52 forms the image of the measurement object S on the basis of the single or plural detection results of the detector 4. The image forming portion 52 can form both two-dimensional images and three-dimensional images.

The control device 5 is a computer that includes an automatic computation function. The control device 5 may be provided not only at one place but also at plural places. For example, the image forming portion 52 forms the image of the measurement object S on the basis of the detection result of the detector 4, but it may be such that the detection result of the detector 4 is transmitted to a plurality of computers, and the detection result of each computer is further integrated by yet another computer. In this case, needless to say, a plurality of control devices composed of the control device 5 connected to the X-ray device with the electric wire and the control device 5 connected wirelessly on the Internet or the like may be used. Thus, for example, the image forming portion 52 of the control device 5 is only required to introduce a program for executing the image forming portion into a computer, so that a plurality of image forming portions 52 of the control device 5 may be used.

In the present embodiment, the control device 5 transmits signals by wire to control the operations of the X-ray source 100, the stage device 3 (stage 9), and the detector 4 in an integrated manner, but may wirelessly transmit the signals. In addition, it may be such that the plurality of control devices 5 are provided, and each of the plurality of control devices 5 controls the operations of the X-ray source 100, the stage device 3 (stage 9), and the detector 4. Further, any control device may control the X-ray devices when the plurality of X-ray devices is controlled.

Next, one example of the operations of the X-ray device 1 will be described. Regarding the detection of the measurement object S, the control device 5 controls the stage device 3 and arranges the measurement object S, which is held by the stage 9, between the X-ray source 100 and the detector 4.

The measurement object S is irradiated with at least part of the X-rays XL generated from the X-ray source 100. Upon the irradiation of the measurement object S with the X-rays XL, at least part of the X-rays XL with which the measurement object S is irradiated transmits through the measurement object S. The transmitted X-rays transmitted through the measurement object S are incident on the incidence surface 33 of the detector 4. The detector 4 detects the transmitted X-rays transmitted through the measurement object S. The detector 4 detects an image of the measurement object S, the image being obtained on the basis of the transmitted X-rays transmitted through the measurement object S. The result of the detection performed by the detector 4 is outputted to the control device 5.

The control device 5 causes the X-ray source 100 to irradiate the measurement object S with the X-rays XL while rotating the stage 9 holding the measurement object S in the θY direction. The control device 5 changes the irradiation area of the X-rays XL from the X-ray source 100 on the measurement object S by changing the position of the measurement object S with respect to the X-ray source 100. The transmitted X-rays transmitted through the measurement object S at each position (each rotation angle) of the stage 9 are detected by the detector 4. The detector 4 obtains the image of the measurement object S at each position. The control device 5 calculates the internal structure of the measurement object S from the results of the detection performed by the detector 4.

Figure 9:
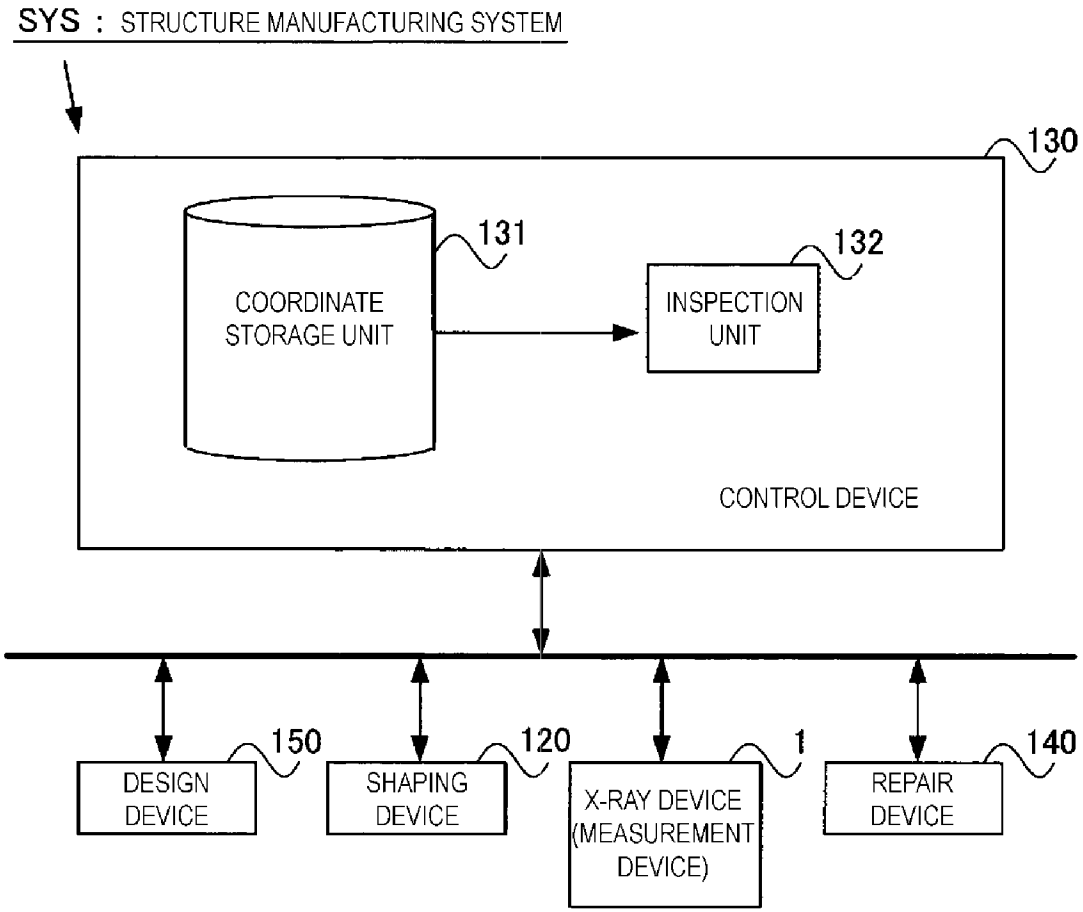
FIG. 9 is a block diagram illustrating one example of a configuration of a structure manufacturing system according to the third embodiment.

Next, the structure manufacturing system including the aforementioned X-ray device 1 will be described. FIG. 9 is a block diagram illustrating one example of a configuration of the structure manufacturing system SYS. The structure manufacturing system SYS includes the X-ray device 1 as a measuring device, a shaping device 120, a control device (inspection device) 130, a repair device 140 and a design device 150. In the present embodiment, the structure manufacturing system SYS produces shaped products such as door components and engine components of automobiles, gear components, and electric components including a circuit board.

The design device 150 generates design information on the shape of a structure and transmits the generated design information to the shaping device 120. In addition, the design device 150 causes a later-described coordinate storage unit 131 of the control device 130 to store the generated design information. Herein, the design information is information indicating coordinates of each position of the structure. The shaping device 120 produces the structure on the basis of the design information inputted from the design device 150. The shaping process of the shaping device 120 includes casting, forging, cutting, and the like.

The X-ray device 1 (measuring device) transmits the information indicating the measured coordinates to the control device 130. The control device 130 includes the coordinate storage unit 131 and an inspection unit 132. As described above, the coordinate storage unit 131 stores the design information from the design device 150. The inspection unit 132 reads out the design information from the coordinate storage unit 131. The inspection unit 132 generates information (shape information) indicating the produced structure from the information that is received from the X-ray device 1 and that indicates the coordinates. The inspection unit 132 compares the information (shape information) indicating the coordinates and received from the X-ray device 1 with the design information read out from the coordinate storage unit 131. The inspection unit 132 determines whether the structure is shaped in accordance with the design information on the basis of the comparison result. In other words, the inspection unit 132 determines whether the produced structure is non-defective. When the structure is not shaped in accordance with the design information, the inspection unit 132 determines whether repairs can be made. When repairs can be made, the inspection unit 132 calculates a defective area and an amount of repair on the basis of the comparison result and transmits information indicating the defective area and information indicating the amount of repair to the repair device 140.

The repair device 140 processes the defective area of the structure on the basis of the information indicating the defective area and the information indicating the amount of repair received from the control device 130.

Figure 10:
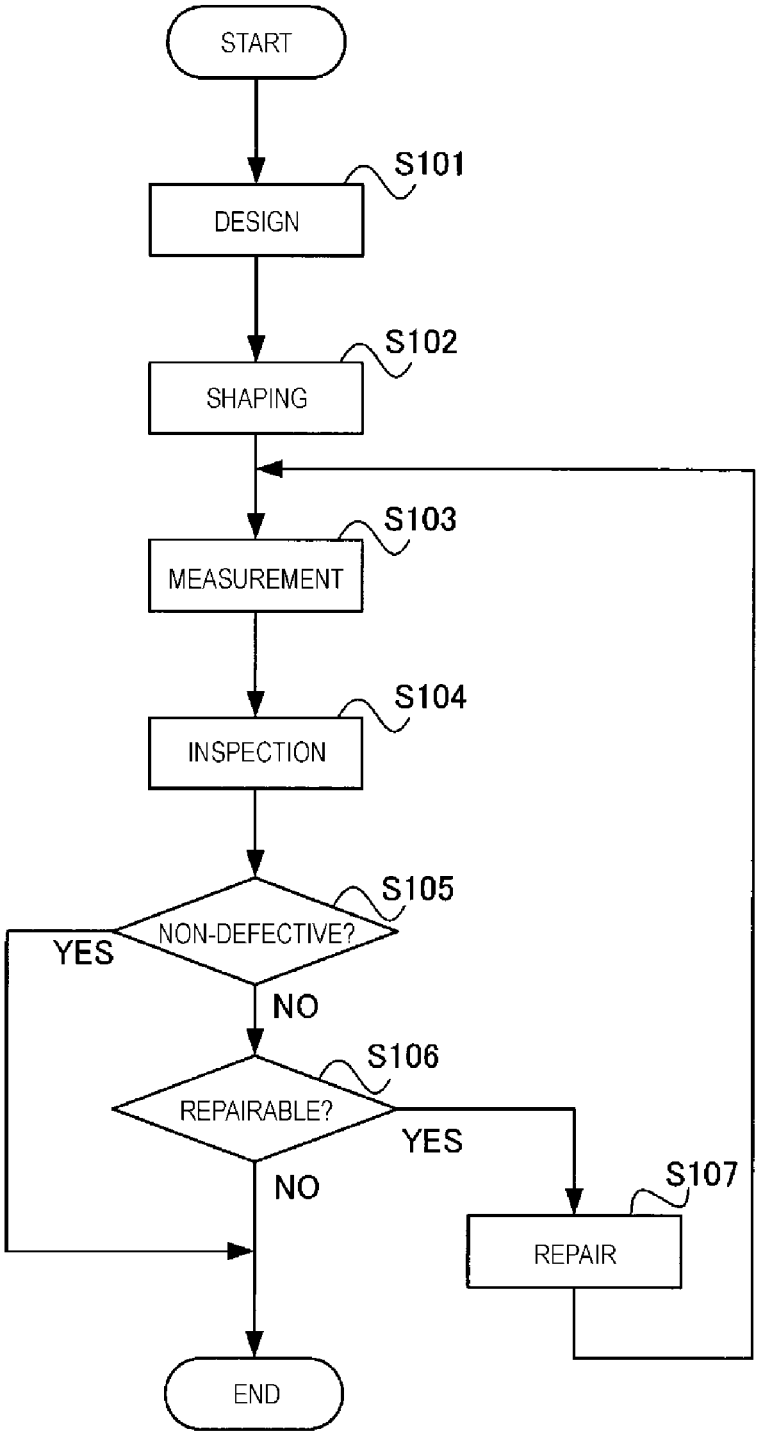
FIG. 10 is a flowchart illustrating the flow of processing performed by the structure manufacturing system according to the third embodiment.

FIG. 10 is a flowchart illustrating the flow of processing performed by the structure manufacturing system SYS. First, the design device 150 produces design information regarding the shape of a structure (step S101). Next, the shaping device 120 produces the aforementioned structure on the basis of the design information (step S102). Next, the X-ray device 1 measures coordinates regarding the shape of the structure (step S103). Next, the inspection unit 132 of the control device 130 inspects whether the structure has been produced in accordance with the design information by comparing the shape information of the structure produced by the X-ray device 1 with the aforementioned design information (step S104).

Next, the inspection unit 132 of the control device 130 determines whether the produced structure is non-defective (step S105). In the case where the produced structure is non-defective (step S105, YES), the structure manufacturing system SYS ends the processing. In contrast, when the produced structure is defective (step S105, NO), the inspection unit 132 of the control device 130 determines whether the produced structure can be repaired (step S106).

When the produced structure can be repaired (step S106, YES), the repair device 140 reprocesses the structure (step S107), and returns to the process of step S103. In contrast, when the produced structure cannot be repaired (step S106, NO), the structure manufacturing system SYS ends the processing. Thus, the processing of this flowchart ends.

As described above, the X-ray device 1 according to the embodiment can accurately measure the coordinates of the structure, so that the structure manufacturing system SYS can determine whether the produced structure is non-defective. Furthermore, the structure manufacturing system SYS can reprocess and repair the structure in the case where the structure is defective.

Note that various aspects of the embodiments described above may be combined as appropriate. Moreover, some of the component parts may be removed. Moreover, to the extent permissible by law, all publications and United States Patent documents related to the detection devices or the like used in the embodiments and modification examples as described above are incorporated herein by reference.

Various embodiments and modification examples have been described above, but the present invention is not limited to the embodiments and modification examples described above. Other aspects that are conceivable within the technical concepts of the present invention are also included within the scope of the present invention.

REFERENCE SIGNS LIST

10 X-ray generation device
20 Electron emitting part
30 Electron irradiated part
40 Container part
51 Electric wire containing part
60 Insertion part
70 Insertion-part-side protrusion part
71 Electron irradiated-part-side protrusion part
90 Rotation member

The invention claimed is:

1. A charged particle device comprising:

an electron emitting part configured to emit electrons;

an electron irradiated part configured to be irradiated with the electrons emitted from the electron emitting part;

a container part configured to evacuate an interior thereof and contain the electron irradiated part in the interior thereof;

an electric wire containing part configured to be inserted toward the electron irradiated part being contained in the interior of the container part from an outside of the container part via an insertion part provided in the container part to contain an electric wire through which electricity is conducted to the electron irradiated part contained in the interior of the container part; and an insertion-part-side protrusion part configured to surround the electric wire containing part and protrude from a vicinity of the insertion part on an inner wall of the container part toward an interior of the container part.

2. The charged particle device according to claim 1, wherein in a flat cross section passing through a center axis of the electric wire containing part, a tip end part of the insertion-part-side protrusion part forms an arc shape.

3. The charged particle device according to claim 1, further comprising a rotation member configured to cause the electron irradiated part to rotate, and wherein the insertion-part-side protrusion part surrounds the rotation member as well as the electric wire containing part.

4. The charged particle device according to claim 1, further comprising an electron irradiated-part-side protrusion part configured to surround the electric wire containing part and protrude from the vicinity of the electron irradiated part toward the interior of the container part.

5. The charged particle device according to claim 4, wherein the electron irradiated-part-side protrusion part protrudes to surround the electric wire containing part and expands from the vicinity of the electron irradiated part toward the interior of the container part.

6. The charged particle device according to claim 5, wherein the electron irradiated-part-side protrusion part protrudes so that the opening diameter thereof increases from the vicinity of the electron irradiated part toward the interior of the container part.

7. The charged particle device according to claim 6, wherein the electron irradiated-part-side protrusion part expands in a conical shape from the vicinity of the electron irradiated part toward the interior of the container part.

8. The charged particle device according to claim 7, wherein a center of a circle formed with a tip end part of the electron irradiated-part-side protrusion part exists on a center axis of the electric wire containing part.

9. The charged particle device according to claim 8, wherein in the flat cross section passing through the center axis of the electric wire containing part, a tip end part of the electron irradiated-part-side protrusion part forms an arc shape.

10. The charged particle device according to claim 1, wherein the charged particle device is an X-ray generation device, and the electron irradiated part emits X-rays by being irradiated with the electrons.

11. A structure manufacturing method comprising:

a design process of producing design information regarding a shape of a structure;

a shaping process of manufacturing the structure based on the design information;

a measuring process of measuring the shape of the manufactured structure by using the charged particle device according to claim 10; and an inspection process of comparing shape information obtained from the measuring process with the design information.

12. The structure manufacturing method according to claim 11, further comprising a repair process of executing reprocess of the structure based on a result of the comparison in the inspection process.

13. The structure manufacturing method according to claim 12, wherein the repair process is a process for re-executing the shaping process.

14. A structure manufacturing system comprising:

a design device configured to produce design information regarding a shape of a structure;

a shaping device configured to manufacture the structure based on the design information;

the charged particle device according to claim 10 configured to measure the shape of the manufactured structure; and an inspection device configured to compare the shape information regarding the shape of the structure, the shape information being obtained by an X-ray device using the X-ray generation device, with the design information.

15. The charged particle device according to claim 1, wherein the insertion-part-side protrusion part protrudes so that surrounds the electric wire containing part and expands from the vicinity of the insertion part toward the interior of the container part.

16. The charged particle device according to claim 15, wherein the insertion-part-side protrusion part protrudes so that the opening diameter thereof increases from the vicinity of the insertion part toward the interior of the container part.

17. The charged particle device according to claim 16, wherein the insertion-part-side protrusion part expands in a conical shape from the vicinity of the insertion part toward the interior of the container part.

18. The charged particle device according to claim 17, wherein a center of a circle formed with a tip end part of the insertion-part-side protrusion part exists on a center axis of the electric wire containing part.

* * * * *